US005638915A

United States Patent [19]

Hardy

[11] Patent Number: 5,638,915

[45] Date of Patent: Jun. 17, 1997

[54] PORTABLE TOOL STORAGE APPARATUS FOR USE WITH A LADDER

[76] Inventor: Charles E. Hardy, 4242 W. Wyndemere Cir., Schnecksville, Pa. 18078

[21] Appl. No.: 589,345

[22] Filed: Jan. 22, 1996

[51] Int. Cl.[6] ..... B65D 85/00

[52] U.S. Cl. ..... 182/129; 206/373

[58] Field of Search ..... 182/129; 248/97; 206/373

[56] References Cited

U.S. PATENT DOCUMENTS 4,356,859 11/1982 McGee ..... 248/97

4,773,535 9/1988 Cook ..... 206/373

*Primary Examiner*—Alvin C. Chin-Shue

*Attorney, Agent, or Firm*—Sanford J. Piltch

[57] ABSTRACT

A portable tool carrying and storage apparatus for use with either a step ladder or extension ladder which is designed to accommodate a wide variety of tools. The portable storage apparatus includes a base portion from which a plurality of skirtings are attached. The skirtings are provided with a variety of pockets and pouches dimensioned to accommodate tools as hand held power tools, screwdrivers, wrenches and tape measures, ties for securing the storage apparatus to the ladder, and a cover flap secured to the respective skirting for retaining tools within the apparatus.

14 Claims, 4 Drawing Sheets

PORTABLE TOOL STORAGE APPARATUS FOR USE WITH A LADDER

BACKGROUND OF THE INVENTION

The present invention relates to a tool storage apparatus and more particularly, to an apparatus which is capable of attachment to a ladder and allows for the transport and storage of a variety of tools.

In the construction trades, ladders are an essential instrument in all areas of a construction project. By its nature, it is difficult to work while on a ladder due to height or a lack of ability of the user to reach both tools and the work place. Thus, it is often necessary to carry one or more tools up the ladder in order to complete a task. Rarely is a job so simple as to be accomplished with only one tool. Often it is necessary to have immediate access to a wide range of tools. Presently, when working on a ladder, one is limited in the number of tools which can be carried up the ladder to the work place.

Several attempts have been made to solve the limitations of working on a ladder. U.S. Pat. No. 4,726,446 [Perbix] describes a protective cover for an extension ladder. This cover fits over the top of the ladder and has a plurality of pads which keep the ladder from scraping the side of the structure against which it is placed. The cover of Perbix also contains a storage pocket. The cover (with pocket) of Perbix has the capacity for storing only an extremely limited number of tools so that the proper tools must be selected and loaded into the pocket of the cover before the ladder is extended. However, the Perbix cover fails to accommodate specific types of tools and construction materials in known, easily accessible positions. Perbix is designed only to be attached to the top of and used only with an extension ladder, and not a different type of ladder, such as a step ladder.

Another approach is described by U.S. Pat. No. 4,356,854 [McGee] which shows a work pouch capable of sitting atop a step ladder. The work pouch has skirting (without securing means) and pockets for specific tools, as well as a carrying handle. From the drawings and description the work pouch of McGee is designed to be used exclusively with a step ladder. The McGee work pouch sits atop the step ladder and is not secured to the ladder by any means other than by its weight when fully loaded with tools. Therefore, if tools are extracted from the pouch, it is possible that McGee will become unbalanced and fall off the ladder causing injury to anyone standing under the ladder. Another shortcoming of McGee is its rigid structure so that the work pouch cannot be folded and easily carried up or down the ladder.

It is apparent that a new type of tool carrying and storage device is needed which can be used with different types of ladders. In addition, it is also advantageous to provide a carrying apparatus which is flexible and can carry a wide variety of tools.

Accordingly, it is a primary object of the present invention to provide a tool storage apparatus which can be used with different types of ladders.

Another object of the present invention is to provide a tool storage apparatus which contains various pouches and pockets which are specifically designed to hold a wide variety of tools.

Yet another object of the present invention is to provide a tool storage apparatus which has a means for attaching the apparatus securely to a ladder.

Another object of the present invention is to provide a tool storage apparatus which is made from a material which is flexible, so that the apparatus may be folded and carried safely up and down a ladder, yet strong enough to hold heavy tools.

Yet another object of the present invention is to provide a tool storage apparatus which includes a flap which closes so as to prevent tools from falling out of the apparatus and causing injury.

Additional objects, advantages, and other novel features of the invention will be set forth in part in the description that follows and in part will become apparent to those skilled in the art upon examination of the following or may be learned with the practice of the invention.

SUMMARY OF THE INVENTION

To achieve the foregoing and other objects of the invention, the portable tool storage apparatus of the present invention is provided. The tool storage apparatus includes a base portion, a primary skirting, a secondary skirting, a means for securing the apparatus to a ladder, and an attachment means for securing the primary skirting and secondary skirting to the base portion.

The base portion rests on either the rung of a conventional extension ladder or on the top of a step ladder. The base portion also includes a carrying handle which is located at the center of the base portion. The primary skirting is attached to the base portion by an attaching means. This attaching means may be permanent such as a sewn stitch or may be temporary such as cooperating snaps which can be snapped together to secure the primary skirting to the base portion.

The primary and secondary skirting include a variety of pocket and pouch arrangements depending upon the needs of the user. For example, the primary skirting can include several drill holders, pockets for holding boxed items such as nails, and pouches for holding tools such as a tape measure. The primary skirting also includes a cover flap which closes over the pouches and pockets preventing the tools from falling out.

The secondary skirting is also attached to the base portion, but may be less permanent means, such as a zipper or straps which can be closed or tied to secure the secondary skirting to the base portion. For a step ladder configuration, the secondary skirting is preferably separable into two halves which are each attached to the left and right side of the base portion. For the conventional extension ladder, the two halves of the secondary skirting are connected together and to the base portion by the attachment means. The secondary skirting in this embodiment is attached to the base portion opposite the primary skirting.

Attached to both the primary and secondary skirting is a means for securing the portable tool storage apparatus to the ladder. One way of accomplishing this is by providing ties or straps. After the user climbs the ladder to the height where the work is to be done and the tool storage apparatus is positioned, the straps are tied to the ladder. Thus, when a tool is removed, no imbalance of the storage apparatus will result.

Still other objects of the present invention will become readily apparent to those skilled in this art from the following description wherein there is shown and described a preferred embodiment of this invention.

BRIEF DESCRIPTION OF THE DRAWINGS

For the purpose of illustrating the invention, there is shown in the drawings forms which are presently preferred.

it being understood, however, that the invention is not limited to the precise arrangements and instrumentalities shown.

DETAILED DESCRIPTION OF THE PREFERRED EMBODIMENTS

The following detailed description is of the best presently contemplated mode of carrying out the invention. The description is not intended in a limiting sense, and is made solely for the purpose of illustrating the general principles of the invention. The various features and advantages of the present invention may be more readily understood with reference to the following detailed description taken in conjunction with the accompanying drawings.

Figure 1:
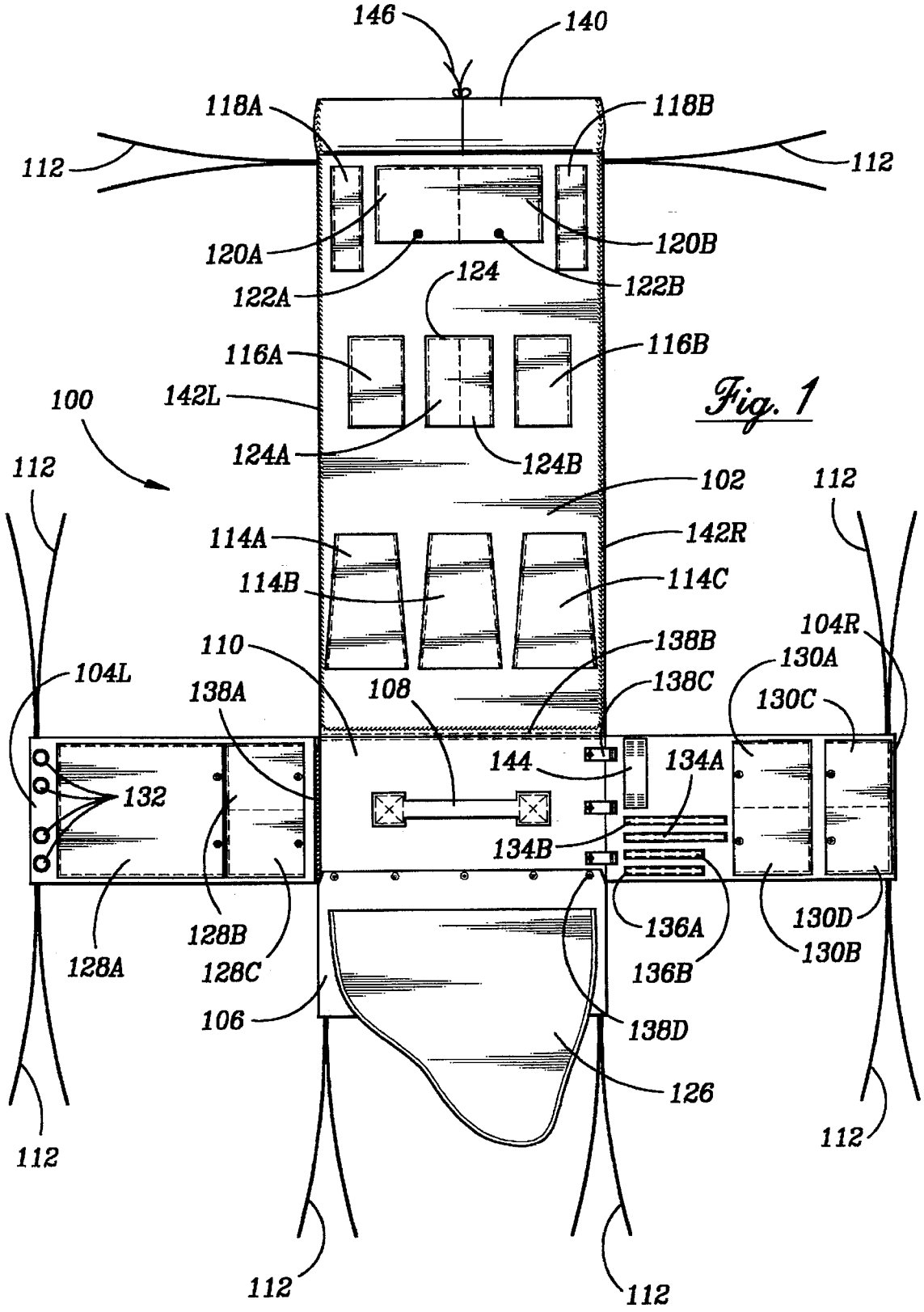
FIG. 1 is a plan view of the portable tool carrying apparatus of the present invention configured for use with a step ladder.

Referring now to the drawings in detail, where like numerals refer to like parts or elements, there is shown in FIG. 1 the portable tool carrying apparatus 100 of the present invention configured for use with a step ladder 10. Central to the apparatus is a rectangular base portion 110 which includes a carrying handle 108 allowing for easy lifting. Attached to base portion 110 are primary or front skirting 102, secondary or side skirting 104 (shown as 104L and 104R) and optional rear skirting 106.

Primary skirting 102, secondary skirting 104 and rear skirting 106 are attached to the base portion 110 by an attaching means 138. As shown in FIG. 1, attaching means 138 can be a zipper closure 138A, a sewn stitch 138B, buttonable or clippable straps 138C, or rivets 138D. The selection of the type of attachment means 138 utilized will depend upon the type of ladder to which the apparatus will be secured.

Primary or front skirting 102 is preferred to be attached to the base portion 110 by a more permanent attachment means such as the sewn stitch 138B. Secondary or side skirting 104 may be attached to base portion 110 by a detachable attachment means such as the zipper 138A.

Figure 5:
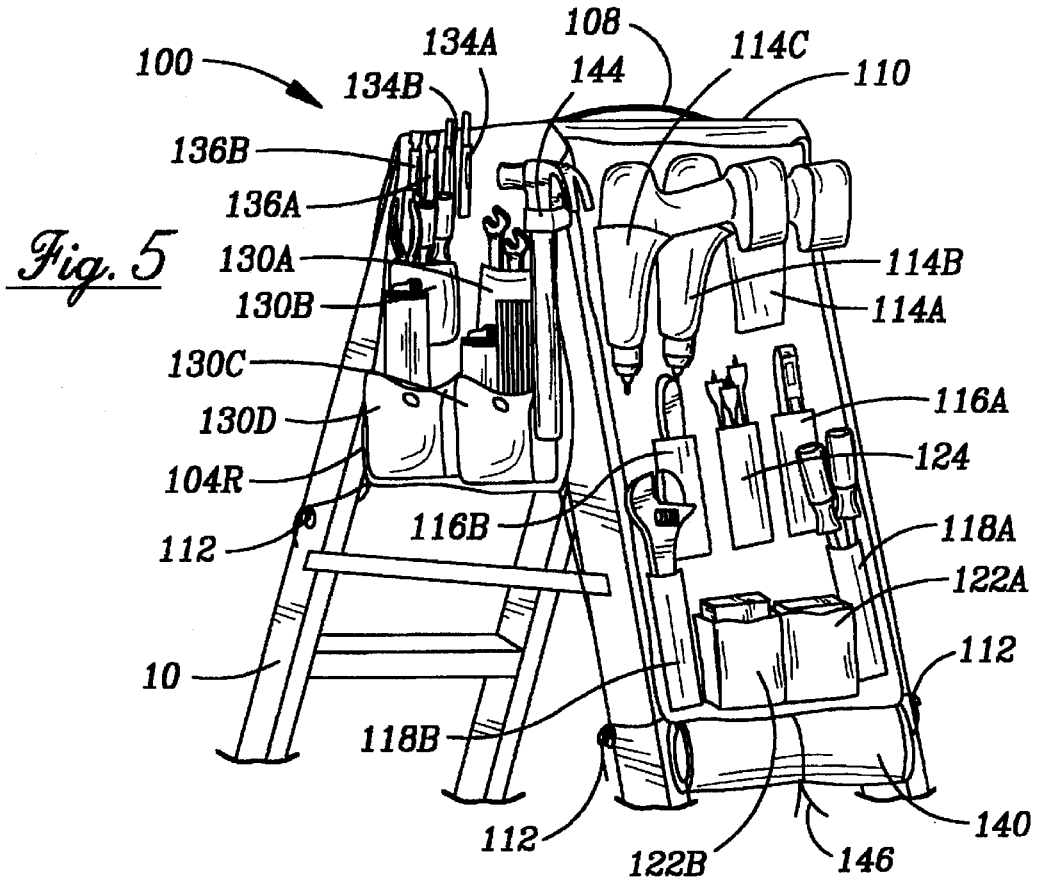
FIG. 5 is a perspective view of the right side rear of the present invention shown attached to a step ladder.
Figure 6:
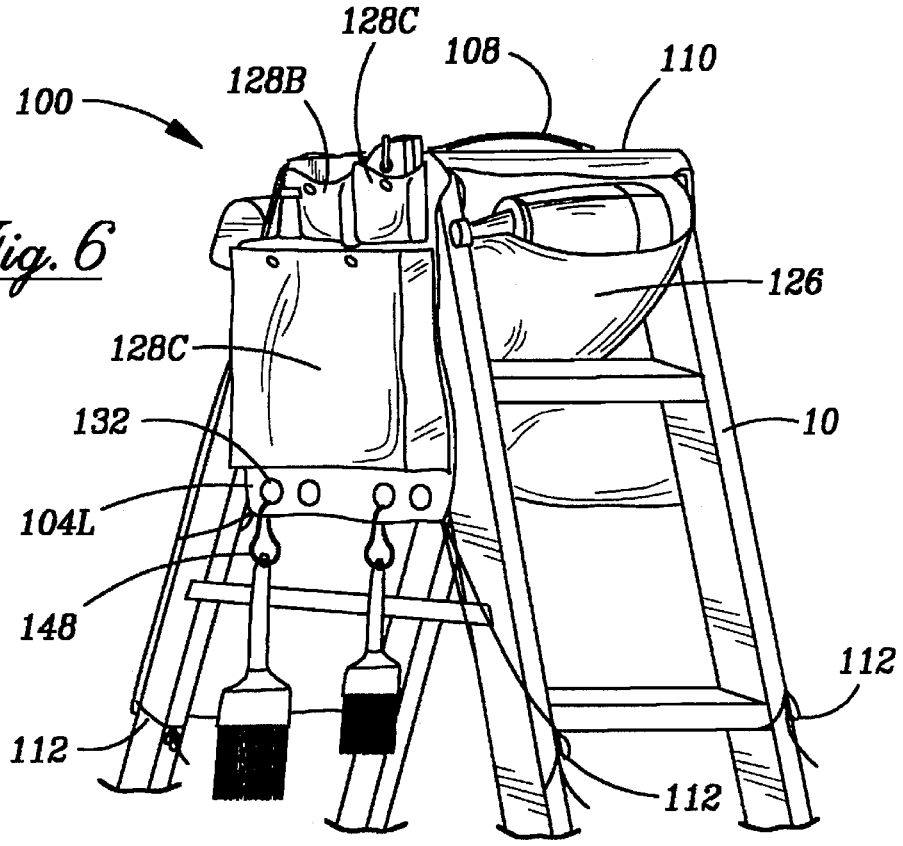
FIG. 6 is a perspective view of the front and left side of the present invention shown attached to a step ladder.

Primary skirting 102 can be further described with reference to FIGS. 1, 5 and 6. Primary skirting 102 includes various pockets and pouches for storing tools. Three holster-like pouches 114A, 114B, 114C are adapted to hold different power hand tools such as drills. Located below the drill pouches 114 are pockets 116A, 116B and 124. Pockets 116A and 116B are of sufficient size to hold tools such as a spackling knife or a level which do not require such expansion. Pocket 124 is divided into pockets 124A and 124B and each is of sufficient size to hold objects such as drill bits. Another set of pockets 118A, 118B and 122 are provided which are located below pockets 116 and 124. Pockets 118A and 118B are of sufficient size so as to hold long handled or shanked tools such as a wrench or a screw driver. Pocket 122 is again divided creating pockets 122A and 122B which are expandable to hold boxes or rigid containers of nails, screws, nuts, washers and the like. Each of the pockets 122A and 122B are securable by snap closures 120A and 120B.

Located at the bottom of primary skirting 102 is flap 140. Flap 140 closes over the pockets and pouches of the primary skirting 102, covering and enclosing them, in order to prevent the tools from falling out and to allow for easy transportation of the portable tool storage apparatus 100. Flap 140 closes by means of zipper 142 which is located along the sides of primary skirting 102 and shown as 142L and 142R and continue along the common side with the base portion 110 to completely enclose the pockets and pouches of primary skirting 102. When unzipped, flap 140 is rolled up and tied at the bottom of primary skirting 102 by means of tie strap 146.

When configured for use with a step ladder, secondary skirting 104 is divided into equal halves forming side skirting 104L and 104R attached to the rectangular base portion 108 along the short sides of the rectangle as shown in FIG. 1. Secondary or side skirting 104L and 104R each have a variety of pockets and pouches. As shown in FIGS. 5 and 6, when the apparatus 100 is placed over a step ladder, side skirting 104L and 104R each hang over the sides of the step ladder.

Side skirting 104L and 104R can further be described with reference to FIGS. 1, 5 and 6. Side skirting 104L includes three large pockets 128A, 128B and 128C. See FIG. 6. Pockets 128B and 128C are each of sufficient size to expand to hold a tape measure or a wound chalk line. Located below pockets 128B and 128C is pocket **128*a* which is of sufficient size to hold an item such as a large container of wood glue. Below pocket 128A are a set of at least four utility eyelets 132. These utility eyelets 132 can be used for positioning hooks 148** from which tools such as paint brushes can be suspended.

Side skirting 104R includes several specialized pockets. See FIG. 5. Pockets 136A and 136B may be used to store long shank nails or drill bits. Pockets 134A and 134B, located adjacent to 136A and 136B may be used to store pencils or other marking tools or nail sets and center punches. Also located at the top of side skirting 104R is flexible strap 144 which serves to hold a hammer. Located below strap 144 are fold-out pockets 130A and 130B which are sized so as to hold wrenches, pliers and screw drivers of various sizes. Pockets 130C and 130D, located below pockets 130A and 130B, are of sufficient size to expand to hold spray paint cans, lubricant containers or a folding scale.

Also provided with portable tool storage apparatus 100 is an optional rear skirting 106 which is described with reference to FIGS. 1 and 6. Optional rear skirting 106 is attached to the rectangular base portion 110 opposite the primary skirting 102 by attaching means 138. Since the rear skirting is optional, it may be attached with snaps 138D. However, if intended for permanent use, rear skirting 106 can be attached with a sewn stitching 138B. Located on rear skirting 106 is a holster-like pouch 126 which is configured to hold a pneumatic nail gun as shown in the referenced figures.

Figure 2:
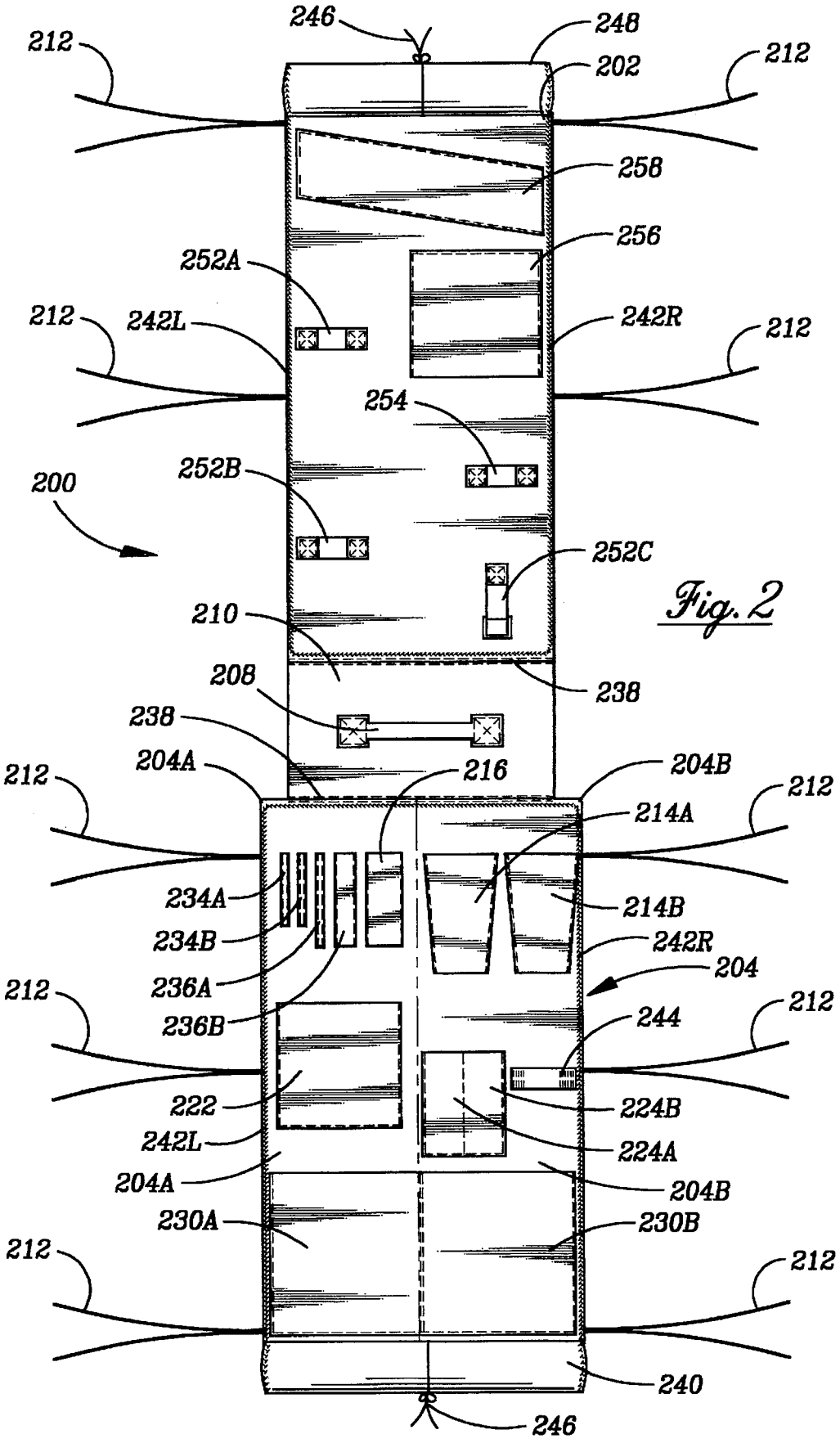
FIG. 2 is a plan view of the portable tool carrying apparatus of the present invention configured for use with a conventional extension ladder.
Figure 3:
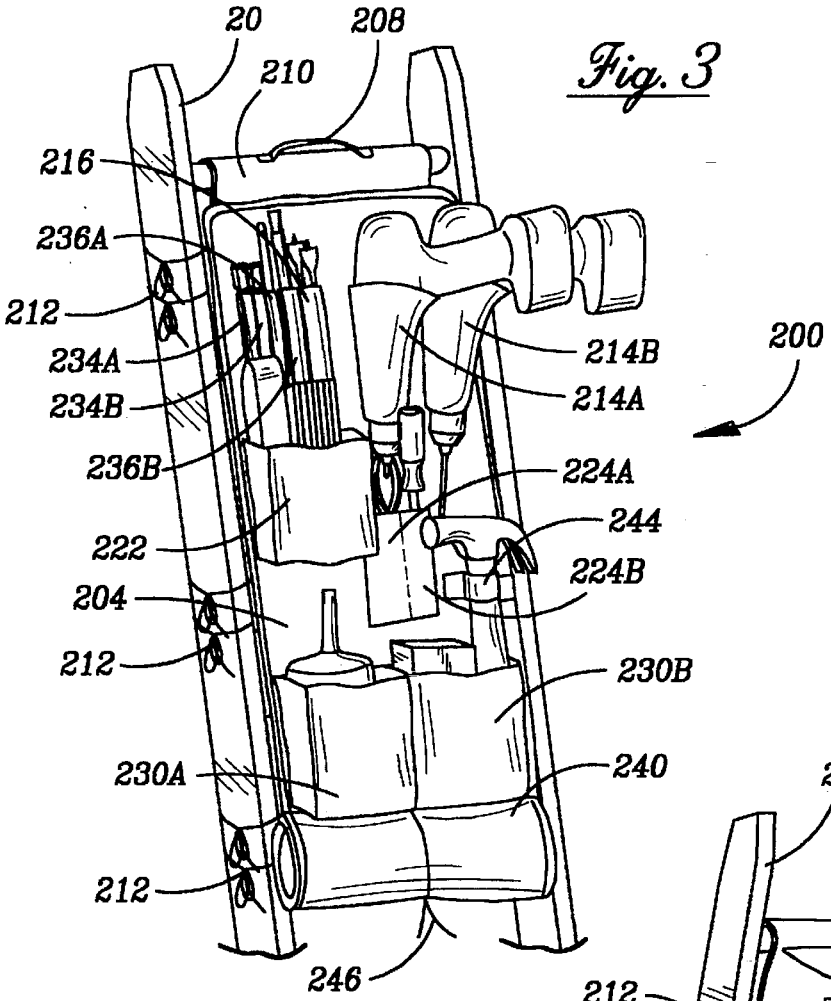
FIG. 3 is a front view of the present invention shown attached to a conventional extension ladder.
Figure 4:
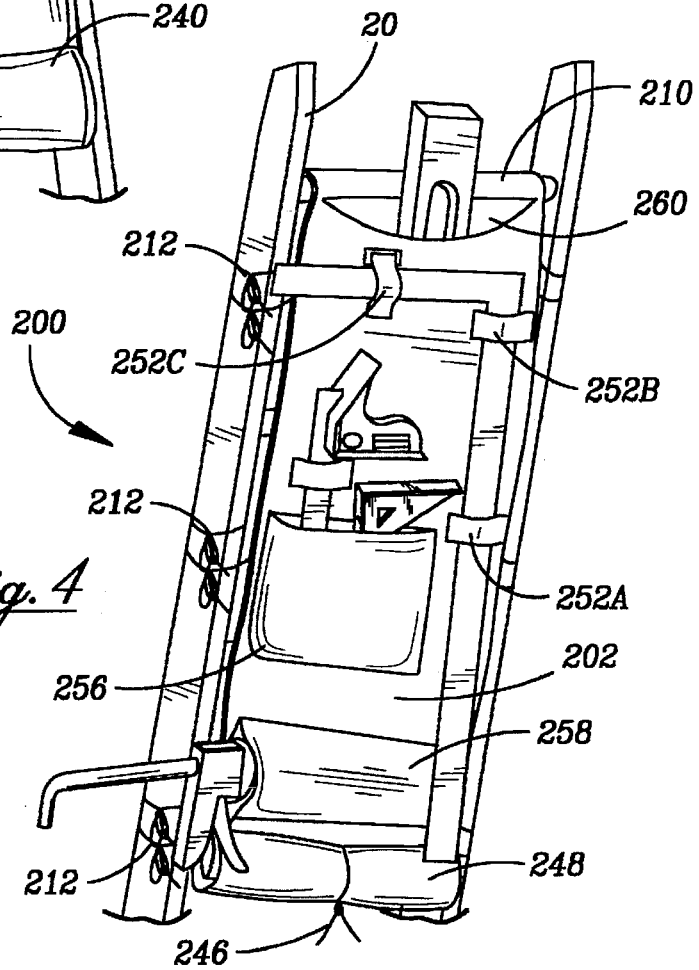
FIG. 4 is a rear view of the present invention shown attached to a conventional extension ladder.

The present invention can also be configured for use with an extension ladder 20 as shown in FIGS. 2, 3 and 4. As shown in FIG. 2, the extension ladder embodiment of the portable tool storage apparatus 200 also includes a primary skirting 202, a secondary skirting 204 and a rectangular base portion 210 with a carrying handle 208 as described above in connection with the portable tool storage apparatus 100. Primary skirting 202 and secondary skirting 204 are attached to base portion 210 by attachment means 238 which are similar to those described above in connection with apparatus 100. An optional rear skirting is not utilized in the extension ladder embodiment.

Secondary skirting 204 is formed by mating skirting segments 204A and 204B to form skirting 204 which is discussed in greater detail below. Secondary skirting 204 is attached to base portion 110 opposite primary skirting 202 also by using attaching means 238. Flap 240 may be zipped up the sides of the secondary skirting 204 and across the common attached side to enclose the secondary skirting 204 using zippers 242R and 242L. When unzipped, flap 240 may be rolled up and tied by using tie strap 246.

FIGS. 2, 3 and 4 show a variety of different pockets and pouches for the purpose of demonstrating the versatile configurations for holding tools and other items which may be retained on portable tool storage apparatus 200. For example, primary skirting 202 includes a series of aligned straps 252A, 252B and 252C which are used to hold an "L-square". The straps 252A and 252B are aligned above one another and strap 252C is offset to one side and turned 90° to accommodate the L-square. Strap 252C is detachable at one end utilizing a VELCRO closure for easy removal and replacement of the L-square.

Primary skirting 202 also includes strap 254 for holding a "T-square". Located below strap 254 and next to strap 252A is a pouch 256 which accommodates the rule portion of the T-square and is sized to contain other tools as well, such as a square. Located at the bottom of primary skirting 202 is a holster-like pouch 258 for accommodating a caulk gun. Also located at the bottom of primary skirting 202 is flap 248. As was described above in connection with flap 240, flap 248 zips over primary skirting 202 in an identical manner utilizing zipper 242L and 242R and keeps the tools located in the various pockets and pouches from falling out when rolled at the distal end of skirting 202, the flap 248 is retained in place with tie 246.

The secondary skirting 204 can further be described with reference to FIGS. 2 and 3. Secondary skirting 204, and in particular the right segment, skirting 204A, includes specialty pockets 234A, 234B, 236A, 236B. Pockets 234A and 234B are used to store long shank nails, drill bits or nail sets, while pocket 236A serves as a pencil or other marker holder and pocket 236B serves as a holder for longer shank high speed metal drill bits. Pocket 216 may be utilized to store tools such as high speed wood drill bits or a level. Pockets 214A and 214B may be utilized to store hand power tools such as drills and the like. Located below these pockets is pocket 222 which stores tools such as a fold out ruler or a razor knife. Located below pocket 222 is pocket 230A which serves to store items such as a box of nails or a large bottle of wood glue.

Side skirting 204B includes holster-like pouches 214A and 214B for accommodating hand held power tools such as drills. Located below holsters 214A and 214B are pockets 216A and 216B are used to store items such as screw drivers or wrenches. Located next to pockets 224A and 224B is strap 244 which is used to store a hammer. Finally, pocket 230B is provided, which, like pocket 230A, serves to store items such as a box of nails or a large bottle of wood glue and which accommodates the handle of the hammer depending from strap 244 above.

As illustrated in FIGS. 1–6, the portable tool storage apparatus 100 and 200 come with a plurality of straps 112 and 212, respectively. Straps 112 and 212 serve as a means to attach either the portable tool storage apparatus 100 or 200 to either type of ladder described, the step ladder 20 or the extension ladder 20.

In operation, the user ascends the ladder and places the portable tool storage apparatus 200 over a rung in the extension ladder 20. After this is accomplished, the portable tool storage apparatus 200 is secured to the ladder by tying straps 212 to the ladder support rails. See FIGS. 2, 5 and 6. The portable tool storage apparatus 100 is secured to a step ladder 10 by tying the ties 112 to respective support rails of the ladder. See FIGS. 1, 3 and 4. Once either of the portable tool storage apparatus 100, 200 are properly positioned and attached with the various skirtings extending over and down the corresponding sides of the respective ladders, the covers 140, 240 and 248 may be unzipped to expose the various tools stored in the plurality of pockets and pouches. At the conclusion of work, the covers 140, 240 and 248 may be zipped closed to contain the various tools in the plurality of pockets and pouches for removal of the apparatus 100, 200 from the position on the ladders without fear of dropping or losing any of the items contained in the pockets or pouches of the portable tool storage apparatus.

The present invention may be embodied in other specific forms without departing from the spirit or essential attributes thereof and, accordingly, the described embodiments are to be considered in all respects as being illustrative and not restrictive, with the scope of the invention being indicated by the appended claims, rather than the foregoing detailed description, as indicating the scope of the invention as well as all modifications which may fall within a range of equivalency which are also intended to be embraced therein.

I claim:

1. A portable tool carrying apparatus for positioning on a ladder comprising;

a rectangular base section dimensioned for positioning the carrying apparatus on said ladder;

a primary skirting having a plurality of differently sized and shaped pockets and pouches for carrying and storing tools depending from a first long side of said rectangular base section;

a secondary skirting formed by securing a left section and a right section together, said secondary skirting having a plurality of differently sized and shaped pockets and pouches for carrying and storing tools and being removably attached to a second long side of said rectangular base section;

a set of cover means which fit over said primary and secondary skirting entirely enclosing the plurality of pockets and pouches for retaining said tools therein; and a means for securing said carrying apparatus to said ladder.

2. The portable tool carrying apparatus of claim 1, wherein said means for securing said carrying apparatus to said ladder are string ties.

3. The portable tool carrying apparatus of claim 1, wherein said rectangular base section further comprises a carrying handle.

4. The portable tool carrying apparatus of claim 1, wherein said plurality of pockets and pouches of said primary skirting are comprised of:

at least one pouch dimensioned to accommodate a hand held power tool;

at least one fold out pocket dimensioned to accommodate one or more bulky containers;

at least one fold out pocket dimensioned to accommodate one or more small diameter round tools;

at least one fold out pocket dimensioned to accommodate one or more long-handled tools;

at least one fold out pocket dimensioned to accommodate one or more long shanked tools; and at least one fold out pocket dimension to accommodate one or more measuring apparatus.

5. The portable tool carrying apparatus of claim 1, wherein said plurality of pockets and pouches of said primary skirting are comprised of:

at least one pouch dimensioned to accommodate a caulk gun;

at least one means for holding a square and rule;

at least one fold out pocket dimensioned to accommodate one or more bulky containers.

6. The portable tool carrying apparatus of claim 1, wherein said plurality of pockets and pouches of said secondary skirting are comprised of:

at least one pouch dimensioned to accommodate a hand-held power tool;

a strap means for holding a hammer;

at least one fold out pocket dimensioned to accommodate a measuring apparatus;

at least one fold out pocket dimensioned to accommodate a marking implement;

at least one fold out pocket dimensioned to accommodate one or more high speed drill bits; and at least one fold out pocket dimensioned to accommodate one or more containers.

7. The portable tool carrying apparatus of claim 1, wherein said plurality of pockets and pouches of said secondary skirting are comprised of:

at least one fold out pocket dimensioned to accommodate one or more marking implements;

at least one fold out pocket dimensioned to accommodate one or more containers;

at least one fold out pocket dimensioned to accommodate a plurality of loose fastening means; and a set of utility eyelets.

8. The portable tool carrying apparatus of claim 1, wherein said left section of said secondary skirting is removably attached to a first short side of said rectangular base section and said right section is removably attached to a second short side of said rectangular base section, said left and right section each having a plurality of differently sized and shaped pockets and pouches for carrying and storing various tools.

9. The portable tool carrying apparatus of claim 1, wherein said cover means for enclosing the plurality of differently sized and shaped pockets and pouches of the primary and secondary skirtings is comprised of a flap having zipper closure means.

10. A portable tool carrying apparatus for positioning on a ladder comprising;

a rectangular base section dimensioned for positioning the carrying apparatus on said ladder;

a primary skirting having a plurality of differently sized and shaped pockets and pouches for carrying and storing tools depending from a first long side of said rectangular base section, said pockets and pouches comprising at least one pocket dimensioned to accommodate a caulk gun, at least one means for holding a square and rule, and at least one fold out pocket dimensioned to accommodate one or more containers;

a secondary skirting formed by securing a left section and a right section together, said secondary skirting having a plurality of differently sized and shaped pockets and pouches for carrying and storing tools and being attached to a second long side of said rectangular base section, said pockets and pouches comprising at least one pouch dimensioned to accommodate a hand-held power tool, a strap means for holding a hammer, at least one fold out pocket dimensioned to accommodate a measuring apparatus, at least one fold out pocket dimensioned to accommodate one or more marking implements, at least one pouch dimensioned to accommodate one or more high speed drill bits, at least one pouch dimensioned to accommodate one or more long shank tools, and at least one fold out pocket dimensioned to accommodate one or more containers;

a set of cover means which fit over said first and second skirting entirely enclosing the plurality of pockets and pouches; and a means for securing said carrying apparatus to said ladder.

11. The portable tool carrying apparatus of claim 10, wherein said cover means for enclosing the plurality of differently sized and shaped pockets and pouches of the primary and secondary skirtings is comprised of a flap having zipper closure means.

12. The portable tool carrying apparatus of claim 10 further comprising another skirting attached to a second long side of and depending from said base section having at least one holster-shaped pouch dimensioned to accommodate a pneumatic nail gun.

13. A portable tool carrying apparatus for positioning on a ladder comprising:

a rectangular base section dimensioned for positioning the carrying apparatus on said ladder;

a primary skirting attached to a first long side of said rectangular base section having a plurality of pockets and pouches for carrying and storing tools depending from said base section, said pockets and pouches comprising at least one pouch dimensioned to accommodate a hand-held power tool, at least one fold out pocket dimensioned to accommodate one or more squares and rules, at least one fold out pocket dimensioned to accommodate one or more long shanked tools, and at least one fold out pocket dimensioned to accommodate one or more containers, and a cover means which fits over said primary skirting enclosing the plurality of pockets and pouches;

a right side skirting attached to a first short side of said rectangular base section having a plurality of pockets and pouches for carrying and storing tools depending from said base section, said pockets and pouches comprising at least one pouch dimensioned to accommodate one or more marking implements, a strap means for holding a hammer, at least one pouch dimensioned to accommodate a nail set, at least one pouch dimensioned to accommodate a center punch, at least one fold out pocket dimensioned to accommodate a one or more long shanked tools, at least one fold out pocket dimensioned to accommodate a measuring device, and at least one fold out pocket dimensioned to accommodate one or more containers;

a left side skirting attached to a second short side of said rectangular base section having a plurality of pockets and pouches for carrying and storing tools depending from said base section, said pockets and pouches comprising at least one fold out pocket dimensioned to accommodate a measuring device, at least one fold out pocket dimensioned to accommodate a large container, and a set of utility eyelets for respectively attaching hook means for hanging tools; and a means for attaching said primary skirting, said left skirting and said right skirting to said rectangular base section; and a means for securing said carrying apparatus to said ladder.

14. The portable tool carrying apparatus of claim 13, wherein said cover means for enclosing the plurality of differently sized and shaped pockets and pouches of the primary skirting is comprised of a flap having zipper closure means.

* * * * *